US005671584A

United States Patent [19]

Mueller

[11] Patent Number: 5,671,584

[45] Date of Patent: Sep. 30, 1997

[54] METHOD AND APPARATUS FOR CONSTRUCTING A RETAINING WALL

[76] Inventor: John F. Mueller, 80 Chamberlain Ave., Novato, Calif. 94947

[21] Appl. No.: 704,156

[22] Filed: Aug. 28, 1996

[51] Int. Cl.[6] ..... E04B 2/60; E04H 17/22

[52] U.S. Cl. ..... 52/780; 52/730.4; 52/731.5; 52/732.3; 52/733.2; 52/736.2; 52/737.6; 52/745.09; 52/764; 52/781; 256/19; 256/24; 256/DIG. 5

[58] Field of Search ..... 52/764, 780, 781, 52/745.12, 745.09, 730.4, 731.5, 732.3, 733.2, 736.2, 737.6, 165; 256/19, 24, DIG. 5

[56] References Cited

U.S. PATENT DOCUMENTS

| | | | |
|---|---|---|---|
| 829,837 | 8/1906 | Gerber | 256/19 |
| 830,437 | 9/1906 | Humphrey | 256/19 X |
| 1,661,128 | 2/1928 | Mankedick | 52/780 X |
| 1,714,949 | 5/1929 | Collier et al. | 256/19 X |
| 3,193,255 | 7/1965 | Burdett | 256/19 |
| 3,698,692 | 10/1972 | Burrows, Jr. | 256/19 |
| 5,076,032 | 12/1991 | Lehman | 52/165 X |

*Primary Examiner*—Christopher T. Kent
*Attorney, Agent, or Firm*—Larry Johnson

[57] ABSTRACT

A retaining wall for remote environments such as wilderness trails utilizes an "H-beam" post member having first and second elongate, vertical plates joined in a spaced, generally parallel relationship by first and second vertical brace portions, so that the cross-section of the resultant construction yields a central cavity between a pair of open web or channel portions. For installation, a stake member (e.g., a segment of rebar or similar material) is driven into the ground, and the central cavity of the H-beam post is placed over the rebar, so that the rebar engages the central cavity and supports the H-beam post. Additional H-beam posts are installed at spaced intervals along the line of the intended retaining wall. Boards, planks or other elongate, sectional materials are inserted into the open webs between adjacent H-beam posts, and are successively stacked to create a wall. Anchors are installed from the H-beam post into the soil or rock for stability. Finally, a cap can be placed on the boards. If a rail is desired, rail posts can be installed into the upper portion of the central cavity of the H-beam post, and rails (e.g., chain) can be extended between rail posts.

6 Claims, 3 Drawing Sheets

METHOD AND APPARATUS FOR CONSTRUCTING A RETAINING WALL

BACKGROUND OF THE INVENTION

1. Field of the Invention

This invention relates generally to construction techniques and hardware, and more specifically to an improved retaining wall structure, and method for its installation, particularly in remote environments.

2. Description of the Prior Art

Roads, trails and other improvements are routinely constructed in remote environments such as mountains, forests and the like. Many such trails and other improvements require the construction of retaining walls to maintain the desired trail, and prevent slippage. However, installation of retaining walls in remote areas can be problematic, due to difficulty in delivering equipment and materials to the site and installing the materials on a slope.

SUMMARY OF THE INVENTION

This invention provides an improved method and apparatus for constructing a retaining wall, particularly in remote environments such as wilderness trails. The inventive apparatus utilizes an "H-beam" post member having first and second elongate, vertical plates joined in a spaced, generally parallel relationship by first and second vertical brace portions, so that the cross-section of the resultant construction yields a central cavity between a pair of open web or channel portions. For installation, a stake member (e.g., a segment of rebar or similar material) is driven into the ground, and the central cavity of the H-beam post is placed over the rebar, so that the rebar engages the central cavity and supports the H-beam post. Additional H-beam posts are installed at spaced intervals along the line of the intended retaining wall. Boards, planks or other elongate, sectional materials are inserted into the open webs between adjacent H-beam posts, and are successively stacked to create a wall. Anchors are installed from the H-beam post into the soil or rock for stability. Finally, a cap can be placed on the boards. If a rail is desired, rail posts can be installed into the upper portion of the central cavity of the H-beam post, and rails (e.g., chain) can be extended between rail posts.

The steel H-beam post design simplifies and speeds up installation of a retaining wall. The inventive system eliminates the need for post hole augers and the carrying of cement to the installation site. The installed system is stronger than wood, and is more fire resistant. In addition, the system provides for handrails, which are becoming critical from a liability standpoint. Furthermore, all the components can be carried to the installation site in a rubber track carrier or similar vehicle.

In soil installation, the H-beam post is driven into the soil with a hydraulic hammer over a piece of one inch rebar which itself has been driven into the soil. In rock conditions, the H-beam post is installed over a rebar piece which is placed into a hole drilled in the rock. Two inch thick wood planks (or other suitable sized material) are slid into the H-beam web and stacked to the desired height. Duckbill anchors are driven into the soil, or expansion anchors are placed into the rock, and fastened to the H-beam posts with one-half inch allthread or their equivalent. Square tubing (e.g., two inch) can be slid into the top of the central cavity of the H-beam posts to provide a railing post for a handrail made by stringing chain or cable between the rail posts.

DETAILED DESCRIPTION OF A PREFERRED EMBODIMENT

Figure 1:
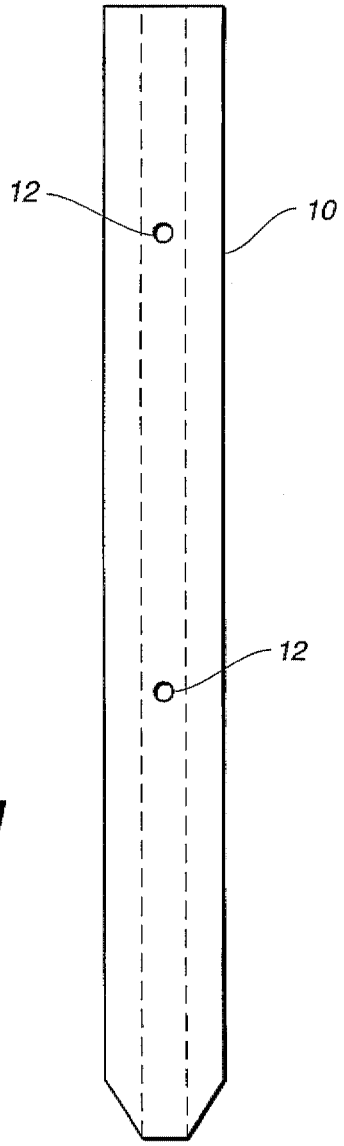
FIG. 1 is a side elevation view of an H-beam post of the retaining wall apparatus of this invention.

FIG. 1 is a side elevation view of an H-beam post 10 of the retaining wall apparatus of this invention. Apertures 12 enable attachment to anchors, as described. H-beam post 10 can be constructed of steel, corten, stainless steel, aluminum or any others suitable material. Typical lengths may be from four feet to twenty feet.

Figure 2:
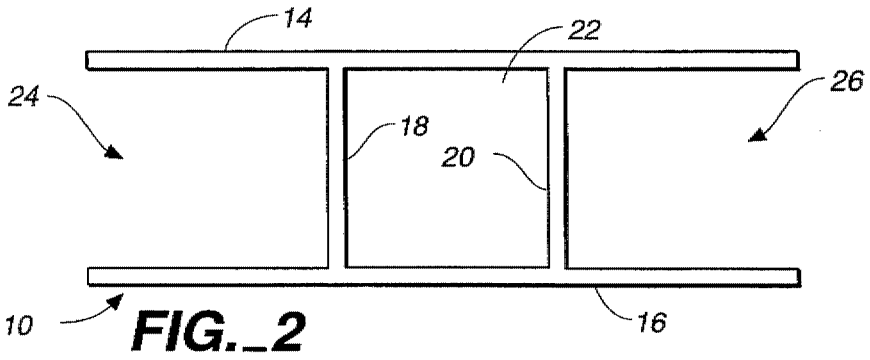
FIG. 2 is a top plan view of an H-beam post of the retaining wall apparatus of this invention.

FIG. 2 is a top plan view of an H-beam post 10 of the retaining wall apparatus of this invention. H-beam post 10 includes first and second elongate, vertical plates 14, 16 joined in a spaced, generally parallel relationship by first and second vertical brace portions 18, 20, thereby defining a central cavity 22 between a pair of open web or channel portions 24, 26. Typical dimensions of this "H" (or possibly more accurately, "double H") may be six, eight, ten or twelve inches wide, two, four, six or eight inches thick (the space between the parallel vertical plates), and made of material of one-eighth to one-half inch thickness.

Figure 3A:
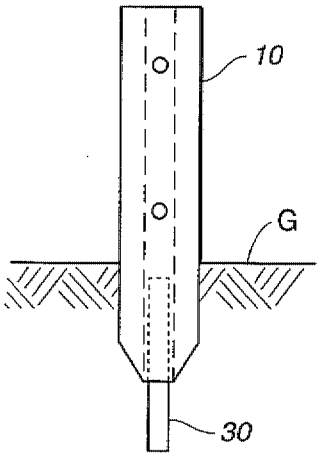
FIGS. 3A–3D are a series of views of the retaining wall apparatus of this invention being installed in a soil environment.
Figure 3B:
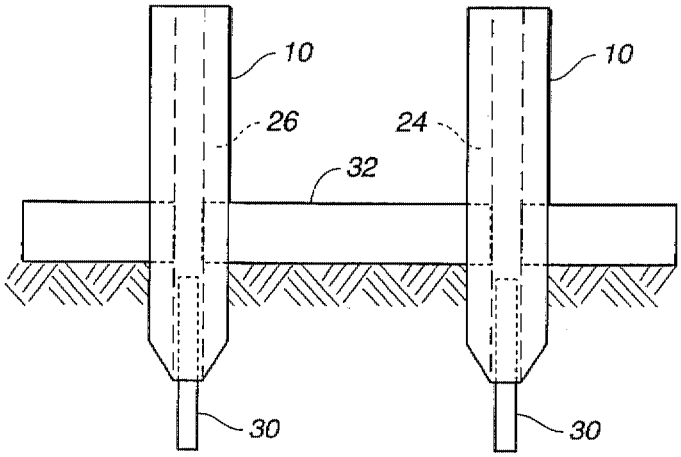
Figure 3D:
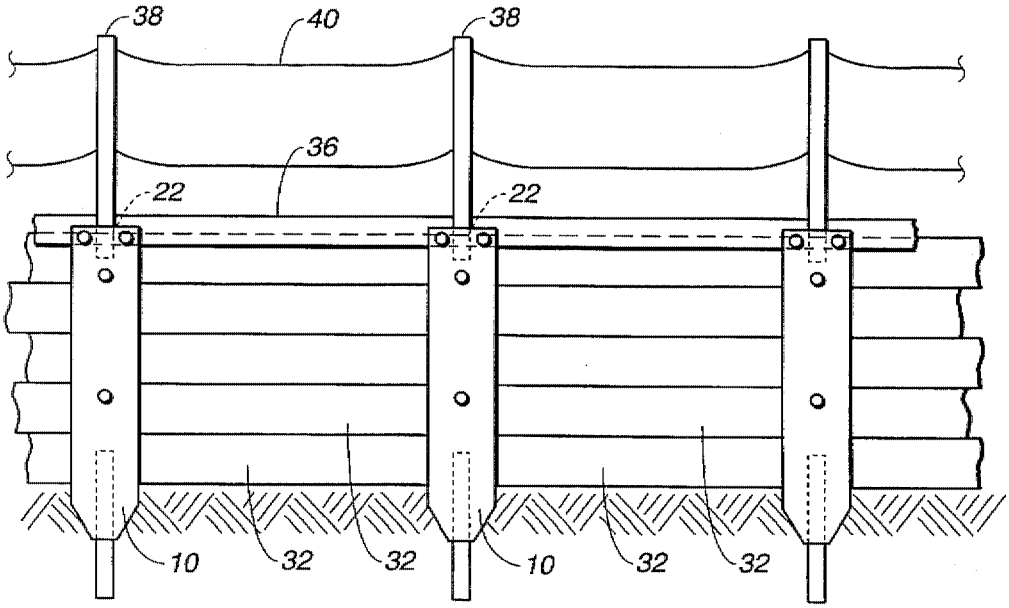
Figure 3C:
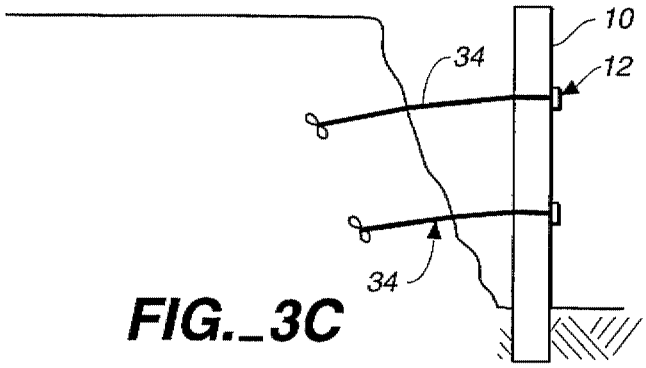

FIGS. 3A–3D are a series of views of the retaining wall apparatus of this invention being installed in a soil environment. FIG. 3A is a front elevation view illustrating an H-beam post 10 driven and placed over a segment of rebar 30, which has been driven into the ground G. FIG. 3B is a front elevation view illustrating a pair of adjacent of H-beam posts 10 thus installed, with a board 32 placed into opposing webs 26, 24 of the adjacent H-beam posts. FIG. 3C is a side elevation view illustrating a pair of earth anchors 34 installed into the soil and extending to apertures 12 in H-beam post 10. FIG. 3D is a front elevation view of a completed retaining wall, with a series of stacked boards 32 forming the wall itself, cap 36 placed upon the stacked boards and secured to adjacent H-beam posts 10, and rail posts 38 inserted into the upper portions of central cavity 22 of adjacent H-beam posts 10, with chain 40 extending between adjacent rail posts 38 to form a rail.

Figure 4A:
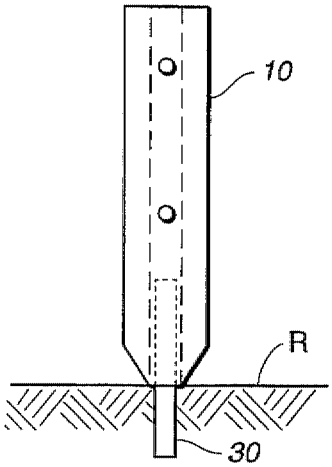
FIGS. 4A–4C are a series of views of the retaining wall apparatus of this invention being installed in a rocky environment.
Figure 4B:
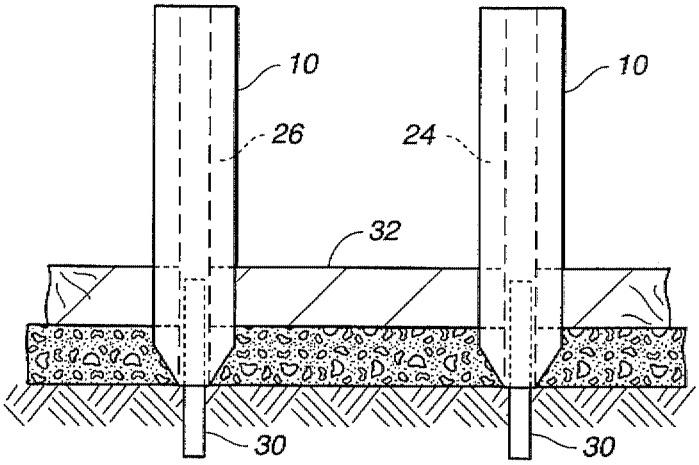
Figure 4C:
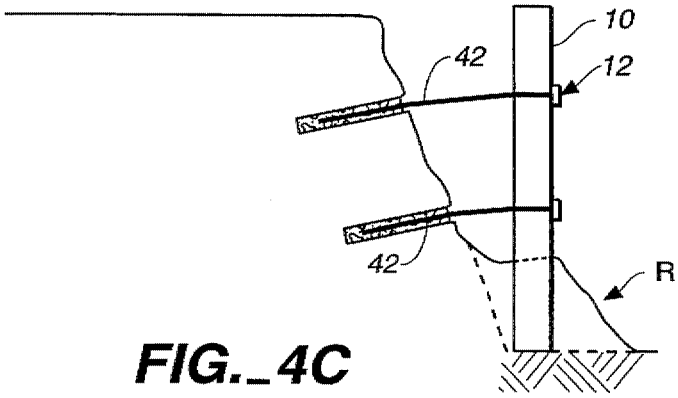

FIGS. 4A–4C are a series of views of the retaining wall apparatus of this invention being installed in a rocky environment. FIG. 4A is a front elevation view illustrating an H-beam post 10 placed over a segment of rebar 30 which has been placed into a hole drilled into rock R. FIG. 4B is a front elevation view illustrating a pair of adjacent H-beam posts 10 thus installed, with a board 32 placed into opposing webs 26, 24 of the adjacent H-beam posts 10. FIG. 4C is a side elevation view illustrating a pair of rock anchors 42 installed into the rock and extending to apertures 12 in H-beam post 10.

Typical installation instructions for the inventive apparatus may include the following:

Step 1—Installation of the first H-beam post a) Soil Conditions—Use a forty-five or sixty pound hydraulic hammer fitted with a driver tool to drive the rebar three to four feet into the soil, followed by driving the H-beam post over the rebar to a depth of approximately one foot into the soil.

b) Rock Conditions—Use a rock drill to drill a one inch hole (slightly oversized) up to twelve inches deep and place a twenty-four inch piece of one inch rebar into the hole. Place the H-beam post over the installed rebar.

2. Step 2—Install all H-beam posts.

Use two inch lumber five feet long to locate the remaining H-beam posts by placing the lumber in the web of each post, and install successive H-beam posts as above. Note: In rocky soil or rock, start the lumber twelve inches up from grade by filling with soil/rock underneath first, since the H-beam post starts at grade.

3. Step 3—Install anchors.

a) Soil Conditions-Use a drive gad and hydraulic hammer to drive the earth anchors into the bank. Fasten these to the H-beam posts with the one-half inch allthread (or equivalent) through the apertures in the H-beam post with a nut and washer.

b) Rock Conditions—Use a rock drill to drill a five-eighths inch hole six inches deep into the rock, and insert expansion anchors and set with a setting tool. Insert one-half inch allthread (or equivalent) through the H-beam posts and screw into the anchor. Fasten to the H-beam posts as above.

4. Step 4—Install metal cap and (optional) hand rail posts.

a) Place the five foot metal caps over the two inch lumber and two inch overlap of the H-beam posts. Drill a three-sixteenth inch hole through the cap into the H-beam post web and fasten there with one-fourth inch metal screws using a one-half inch drill.

b) If a railing is required, slide a fifty-four inch long by two inch square piece of tubing into the top central cavity of the H-beam post, and fasten there with metal screws. String chain or cable to tie these rail posts together, either by clamping to the rail posts or stringing the cable through holes in the rail posts.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and equivalents.

What is claimed is:

1. A retaining wall apparatus comprising:

a plurality of stake members adapted to be driven into the ground;

a plurality of post members, each post member having first and second elongate, vertical plates joined in a spaced, generally parallel relationship by first and second vertical brace portions, thereby defining a central cavity between a pair of open web portions; and at least one plank member, wherein when said stake members are driven into the ground, said post members are placed over said stake members so that said stake members are inserted into and engage said post member central cavity, and said at least one plank member is inserted between opposing web portions of adjacent post members to form a wall.

2. The retaining wall apparatus of claim 1 wherein said at least one plank member is a plurality of plank members.

3. The retaining wall apparatus of claim 1 further including a cap member connected to said at least one plank member and adjacent post members.

4. The retaining wall apparatus of claim 1 further including rail posts inserted into said central cavity of said post members.

5. A method of constructing a retaining wall, said method comprising the steps of:

driving a plurality of stake members into the ground;

providing a plurality of post members, each post member having first and second elongate, vertical plates joined in a spaced, generally parallel relationship by first and second vertical brace portions, thereby defining a central cavity between a pair of open web portions, and placing said post members over said stake members so that said stake members engage said post members central cavities; and;

inserting a plurality of elongate, sectional plank members into said open web portions of adjacent post members to form a wall.

6. The method of claim 5 further including the step of:

anchoring said post members with ground anchors.

* * * * *